US010500845B2

(12) United States Patent
Hatta

(10) Patent No.: US 10,500,845 B2
(45) Date of Patent: Dec. 10, 2019

(54) PRINTING APPARATUS AND METHOD FOR ALLOCATING POWER CIRCUITS IN THE PRINTING APPARATUS

(71) Applicant: BROTHER KOGYO KABUSHIKI KAISHA, Nagoya-shi, Aichi-ken (JP)

(72) Inventor: Fumika Hatta, Kuwana (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/472,647

(22) Filed: Mar. 29, 2017

(65) Prior Publication Data

US 2017/0282547 A1 Oct. 5, 2017

(30) Foreign Application Priority Data

Mar. 30, 2016 (JP) ..... 2016-069116

(51) Int. Cl.
*B41J 29/38* (2006.01)
*B41J 2/045* (2006.01)

(52) U.S. Cl.
CPC ..... *B41J 2/04541* (2013.01); *B41J 2/0459* (2013.01); *B41J 2/04506* (2013.01); *B41J 2/04581* (2013.01); *B41J 2/04586* (2013.01)

(58) Field of Classification Search
None
See application file for complete search history.

(56) References Cited

U.S. PATENT DOCUMENTS 6,290,333 B1 9/2001 Wade et al.
2007/0262778 A1* 11/2007 Ando ..... G01N 27/045 324/425
2007/0296771 A1 12/2007 Ou et al.
2011/0090273 A1* 4/2011 Miyazaki ..... B41J 2/04553 347/10

(Continued)

FOREIGN PATENT DOCUMENTS

JP 2008-173910 A 7/2008
JP 2009-285998 A 12/2009

OTHER PUBLICATIONS

Extended European Search Report dated Sep. 6, 2017 from related EP 17163682.2.

(Continued)

*Primary Examiner* — Matthew Luu
*Assistant Examiner* — Tracey M McMillion
(74) *Attorney, Agent, or Firm* — Scully, Scott, Murphy & Presser, P.C.

(57) ABSTRACT

A printing apparatus includes first and second actuators for exerting force to liquid, the number of the second actuators being smaller than the number of the first actuators; a switching circuit; first, second and third power circuits for applying voltages to the first and second actuators; and a controller for controlling driving of the first and second actuators. The controller is configured to control the switching circuit to electrically connect the first power circuit and some of the first actuators, electrically connect the second power circuit to the other of the first actuators and electrically connect the third power circuit to the second actuators, based on the number of the first actuators and the number of the second actuators.

11 Claims, 18 Drawing Sheets

(56) References Cited

U.S. PATENT DOCUMENTS

2015/0029251 A1* 1/2015 Tabata ..... B41J 2/0452
347/10
2015/0314595 A1* 11/2015 Sano ..... B41J 2/04541
347/10

OTHER PUBLICATIONS

Chinese Official Action dated Feb. 25, 2019 received from the Chinese Patent Office in related application CN 201710173286.7 together with an English language translation.

* cited by examiner

| RANK | THE NUMBER OF NOZZLES | DRIVE VOLTAGE (V) | POWER SOURCE NUMBER |
|---|---|---|---|
| A | 10 | 24.4 | 4 |
| B | 350 | 25.2 | 3 |
| C | 800 | 26.0 | 1, 5 |
| D | 500 | 26.8 | 2 |
| E | 20 | 27.6 | 6 |

Fig. 10

| RANK | THE NUMBER OF NOZZLES | DRIVE VOLTAGE (V) | POWER SOURCE NUMBER |
|---|---|---|---|
| A | 5 | 25.3→26.2 | 4 |
| B | 150 | 26.2 | 4 |
| C | 870→(310) | 27.1 | 1, 3 |
| D | 630→ (70) | 28.0 | 2, 5 |
| E | 25 | 28.9 | 6 |

Fig. 12

| RANK | THE NUMBER OF NOZZLES | DRIVE VOLTAGE (V) | POWER SOURCE NUMBER |
|---|---|---|---|
| A | 5 | 25.3 | |
| B | 150 | 26.2 | |
| C | 870 | 27.1 | |
| D | 630 | 28.0 | |
| E | 25 | 28.9 | 6 |

Fig. 13

| RANK | THE NUMBER OF NOZZLES | DRIVE VOLTAGE (V) | POWER SOURCE NUMBER |
|---|---|---|---|
| A | 5 | 25.3→26.2 | 5 |
| B | 150 | 26.2 | 5 |
| C1 | 435 | 27.1 | 1 |
| C2 | 435 | 27.1 | 2 |
| D1 | 315 | 28 | 3 |
| D2 | 315 | 28 | 4 |
| E | 25 | 28.9 | 6 |

Fig. 15

| RANK | THE NUMBER OF NOZZLES | DRIVE VOLTAGE (V) | POWER SOURCE NUMBER |
|---|---|---|---|
| A | 7 | 25.3 | |
| B | 150 | 26.2 | |
| C | 1200 | 27.1 | |
| D | 300 | 28 | |
| E | 23 | 28.9 | 6 |

Fig. 16

| RANK | THE NUMBER OF NOZZLES | DRIVE VOLTAGE (V) | POWER SOURCE NUMBER |
|---|---|---|---|
| A | 7 | 25.3 | |
| B | 150 | 26.2 | |
| C | 1200→(640) →(80) | 27.1 | 1, 2 |
| D | 300 | 28 | |
| E | 23 | 28.9 | 6 |

Fig. 17

| RANK | THE NUMBER OF NOZZLES | DRIVE VOLTAGE (V) | POWER SOURCE NUMBER |
|---|---|---|---|
| A | 7 | 25.3 | 5 |
| B | 150+40 | 26.2 | 4 |
| C | 1120 | 27.1 | 1, 2 |
| D | 300+40 | 28 | 3 |
| E | 23 | 28.9 | 6 |

| DRIVE VOLTAGE | MAXIMUM NUMBER OF DRIVABLE NOZZLE X | MAXIMUM NUMBER OF DRIVABLE NOZZLE Y |
|---|---|---|
| $26 < V \leqq 32$ | 560 | 420 |
| $18 < V \leqq 26$ | 840 | 630 |
| $V \leqq 18$ | 1680 | 1260 |

Fig. 21

| NOZZLE ADDRESS | RANK | POWER SOURCE NUMBER |
|---|---|---|
| 1 | B | 4 |
| 2 | E | 5 |
| ⋮ | ⋮ | ⋮ |
| k | C | 1 |
| k+1 | C | 3 |
| k+2 | C | 1 |
| k+3 | C | 3 |
| k+4 | C | 3 |
| k+5 | C | 1 |
| ⋮ | ⋮ | ⋮ |
| 1680 | A | 4 |

PRINTING APPARATUS AND METHOD FOR ALLOCATING POWER CIRCUITS IN THE PRINTING APPARATUS

CROSS REFERENCE TO RELATED APPLICATION

The present application claims priority from Japanese Patent Application No. 2016-069116, filed on Mar. 30, 2016, the disclosure of which is incorporated herein by reference in its entirety.

FIELD OF THE INVENTION

The present invention relates to a printing apparatus jetting ink from nozzles and to a method for allocating power circuits in the printing apparatus.

DESCRIPTION OF THE RELATED ART

When the same drive voltage is applied respectively to nozzles, the nozzles have different jetting amounts (jetting velocities) of liquid droplets according to the properties of the nozzles. Conventionally, therefore, such liquid droplet jet apparatuses have been proposed as to select an optimal drive voltage for each nozzle such that the jetting amounts of liquid droplets from the nozzles may be equalized (for example, see Japanese Patent Application Laid-open No. 2008-173910).

In order to select the optimal drive voltage, it is necessary to provide a plurality of power sources having different voltages.

SUMMARY

However, if there are many nozzles having the same optimal drive voltage, then a large amount of electric power has to be supplied by one power circuit corresponding to those nozzles. Hence, it is necessary to prepare a power circuit capable of supplying a large amount of electric power and, meanwhile, the size of the power circuit capable of supplying a large amount of electric power is also large.

The present teaching is made in view of the above situation, and an object thereof is to provide a printing apparatus capable of providing a plurality of power circuits while downsizing the power circuits to restrain the apparatus from growing in size.

BRIEF DESCRIPTION OF THE DRAWINGS

FIG. 10 is a conceptual diagram depicting an example of allocation table for power circuits in a printing apparatus according to a second embodiment.

FIG. 12 is a conceptual diagram depicting an example of allocation table for power circuits before allocating the power circuits in a printing apparatus according to a third embodiment.

FIG. 13 is a conceptual diagram depicting an example of allocation table for the power circuits after allocating the power circuits in the third embodiment.

FIG. 15 is a conceptual diagram depicting an example of allocation table for power circuits before allocating the power circuits in a printing apparatus according to a fourth embodiment.

FIG. 16 is a conceptual diagram depicting an example of allocation table for the power circuits in the course of allocating the power circuits in the fourth embodiment.

FIG. 17 is a conceptual diagram depicting an example of allocation table for the power circuits after allocating the power circuits in the fourth embodiment.

FIG. 21 is a table depicting an example of relationship between a nozzle address, rank, and power source number in a printing apparatus according to a seventh embodiment.

DESCRIPTION OF THE EMBODIMENTS

First Embodiment

Referring to FIGS. 1 to 9, a printing apparatus according to a first embodiment will be explained below.

Figure 1:
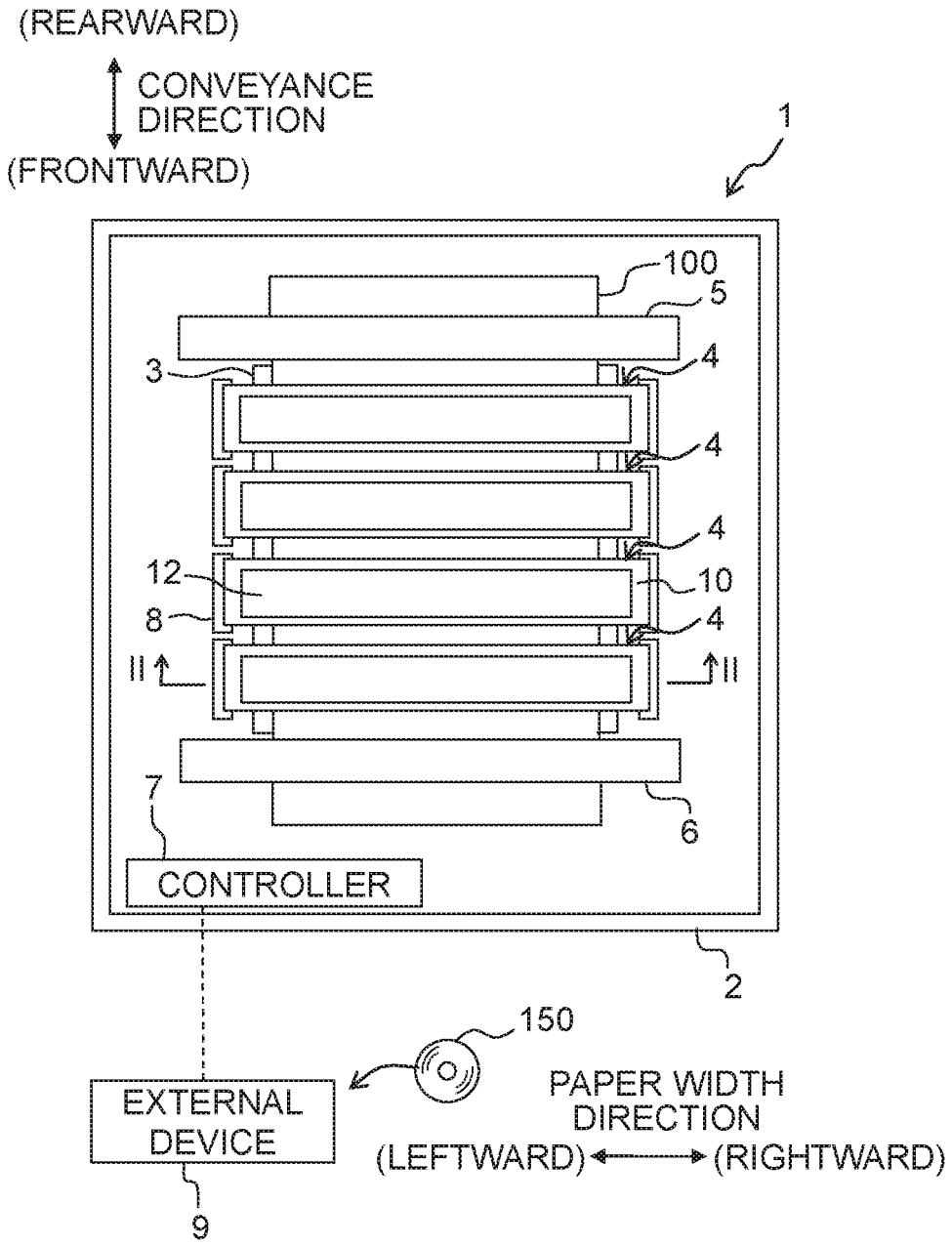
FIG. 1 is a plan view schematically depicting a printing apparatus according to a first embodiment of the present teaching.

In FIG. 1, the front side of a printing apparatus 1 is defined on the downstream side in a conveyance direction of recording paper 100, whereas the rear side of the printing apparatus 1 is defined on the upstream side in the conveyance direction. Further, the left-right direction of the printing apparatus 1 is defined in such a direction along the paper width as is parallel to the conveyance plane of the recording paper 100 (the plane parallel to the page of FIG. 1) and is orthogonal to the conveyance direction. Further, the left side of FIG. 1 is the left side of the printing apparatus 1 whereas the right side of FIG. 1 is the right side of the printing apparatus 1. Further, the upper-lower or vertical direction of the printing apparatus 1 is defined in a direction orthogonal to the conveyance plane of the recording paper 100 (a direction orthogonal to the page of FIG. 1). In FIG. 1, the front or near side of the page is the upper side whereas the rear side or far side of the page is the lower side. Those defined front, rear, left, right, upper, and lower will be used appropriately in the following explanation.

As depicted in FIG. 1, the printing apparatus 1 includes a casing 2, a platen 3, four ink-jet heads 4, two conveyance rollers 5 and 6, and a controller 7.

The platen 3 is placed horizontally in the casing 2. The recording paper 100 is placed on the upper surface of the platen 3. The four ink-jet heads 4 are provided above the platen 3 to be juxtaposed in the front-rear direction. The two conveyance rollers 5 and 6 are arranged respectively on the rear side and the front side of the platen 3. The two conveyance rollers 5 and 6 are driven respectively by an undepicted motor to convey the recording paper 100 on the platen 3 to the front side.

The controller 7 includes non-volatile memories and the like such as a plurality of FPGAs 71*a* and 72*a* (Field Programmable Gate Array; see FIG. 4), a ROM (Read Only Memory), a RAM (Random Access Memory), and an EEPROM (Electrically Erasable Programmable Read-Only Memory). Further, illustration of the ROM, RAM, EEPROM and the like is omitted here. Further, the controller 7 is connected with an external device 9 such as a PC or the like in a data communicable manner, to control each device of the printing apparatus 1 based on print data sent from the external device 9.

For example, the controller 7 controls the motor for driving the conveyance rollers 5 and 6 to cause the conveyance rollers 5 and 6 to convey the recording paper 100 in the conveyance direction. Further, the controller 7 controls the ink-jet heads 4 to jet inks toward the recording paper 100. By virtue of this, image is printed on the recording paper 100.

Head holders 8 are installed in the casing 2. The head holders 8 are arranged above the platen 3 and juxtaposed in the front-rear direction between the conveyance rollers 5 and 6. The head holders 8 hold the ink-jet heads 4 respectively.

The four ink-jet heads 4 respectively jet the inks of four colors: cyan (C), magenta (M), yellow (y), and black (K). Each of the ink-jet heads 4 is supplied with the ink of the corresponding color from an undepicted ink tank.

Figure 2:
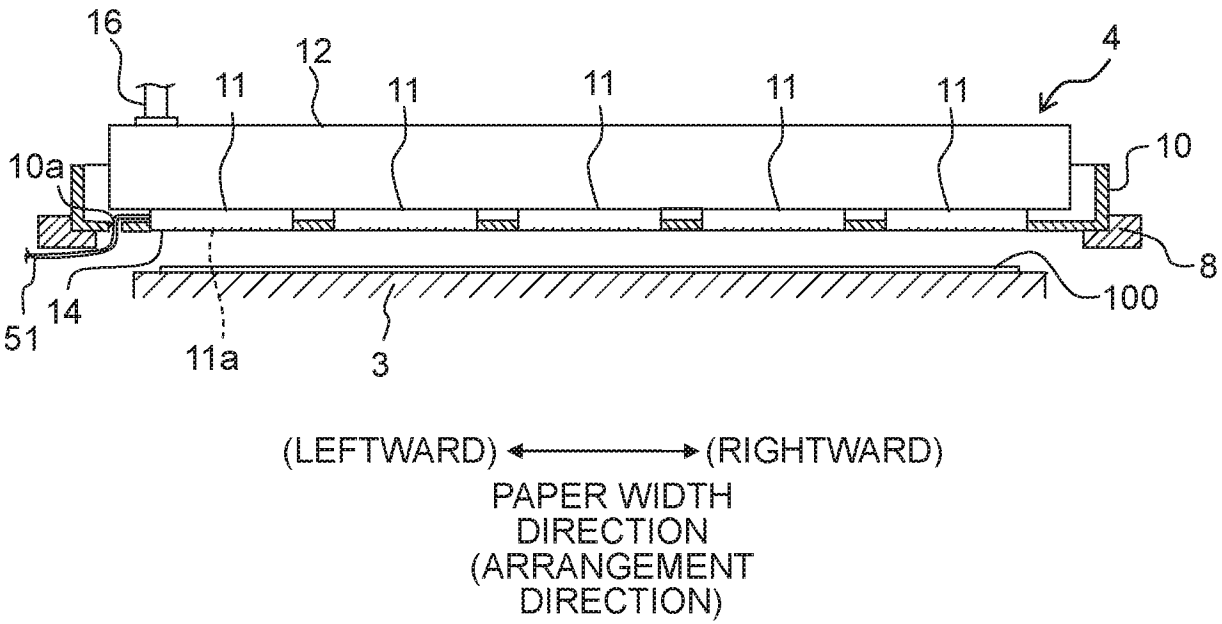
FIG. 2 is a schematic cross-sectional view taken along the line II-II depicted in FIG. 1.
Figure 3:
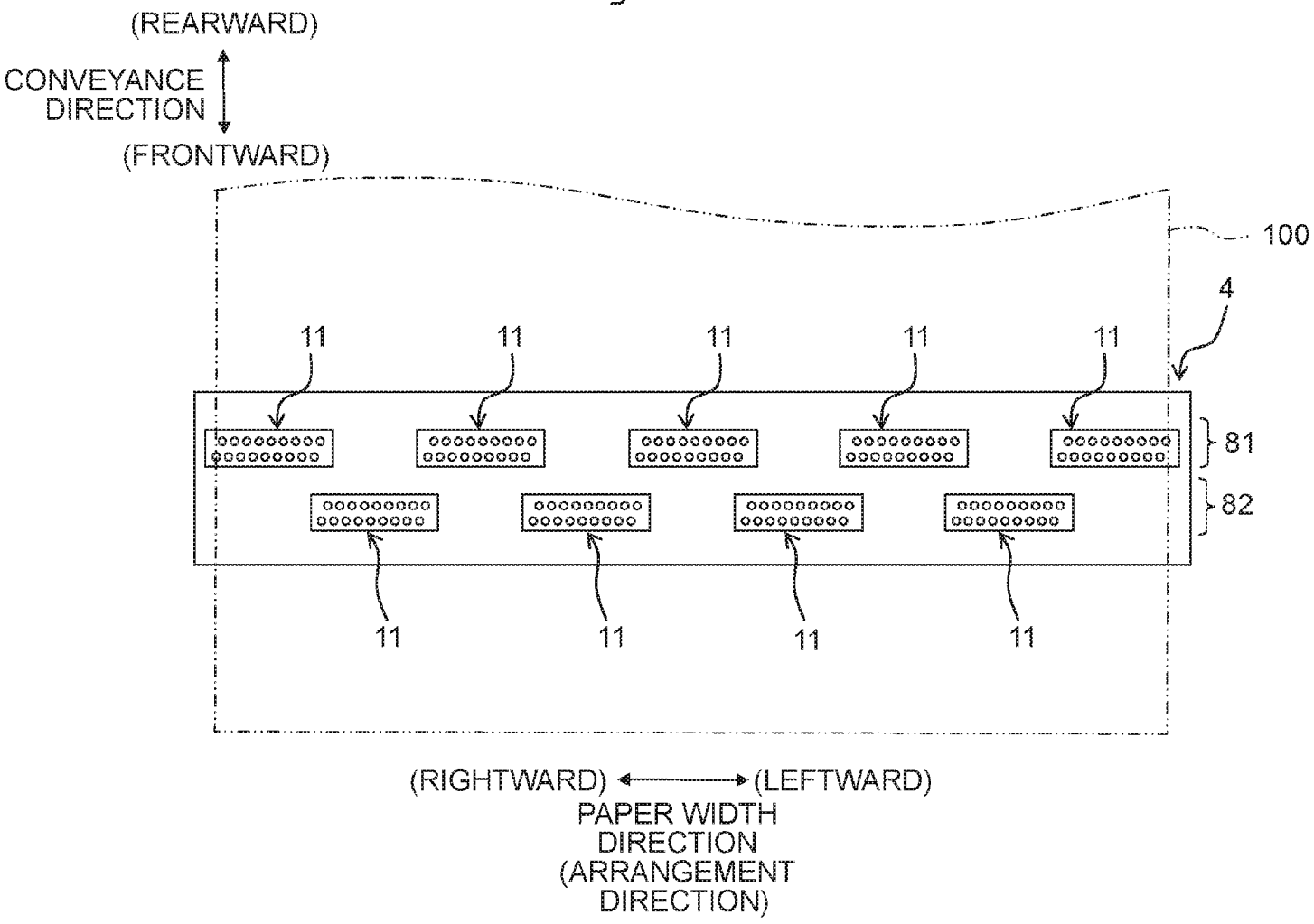
FIG. 3 is a bottom plan view of an ink-jet head.

As depicted in FIGS. 2 and 3, each of the ink-jet heads 4 includes a holder 10 in a rectangular plate-like shape elongated in the paper width direction, and head units 11 attached to the holder 10.

A plurality of nozzles 11*a* (actuators) are formed on the lower surface of each of the head units 11. Each of the nozzles 11*a* includes an aftermentioned piezoelectric body 11*b* (see FIG. 6). The plurality of nozzles 11*a* of each of the head units 11 are juxtaposed along the paper width direction which is the longitudinal direction of the ink-jet heads 4, and the head units 11 form a first head row 81 and a second head row 82. The first head row 81 and the second head row 82 are juxtaposed in the conveyance direction and the first head row 81 is positioned on the rear side of the second head row 82.

As depicted in FIG. 3, a left end portion of each head unit 11 in the first head row 81 is at the same position as a right end portion of one head unit 11 in the second head row 82 in the left-right direction. In other words, the left end portion of each head unit 11 in the first head row 81 overlaps with the right end portion of one head unit 11 in the second head row 82 in the front-rear direction.

As depicted in FIG. 2, the holder 10 is provided with a slit 10*a*. A flexible substrate 51 connects the head units 11 and the controller 7, and the flexible substrate 51 is inserted through the slit 10*a*.

The head units 11 are arranged along an arrangement direction which is the paper width direction. The head units 11 are arranged to be alternately separate between the front side and the rear side in the conveyance direction. Between the head units 11 arranged on the front side and the head units 11 arranged on the rear side, there is a positional deviation on the left and the right (in the arrangement direction). In this embodiment, the head units 11 are juxtaposed along the direction orthogonal to the conveyance direction (along the paper width direction). However, the head units 11 may be arranged obliquely, that is, along a direction intersecting the conveyance direction at an angle other than 90 degrees.

As depicted in FIGS. 1 and 2, a reservoir 12 is provided above the head units 11. An illustration of the reservoir 12 is omitted in FIG. 3.

The reservoir 12 is connected to one of the ink tanks (not depicted) via a tube 16 to temporarily retain the ink supplied from the ink tank. The reservoir 12 has a lower portion connected to the head units 11 to supply each of the head units 11 with the ink from the reservoir 12. Further, the head units 11 may be moved in the paper width direction.

Figure 4:
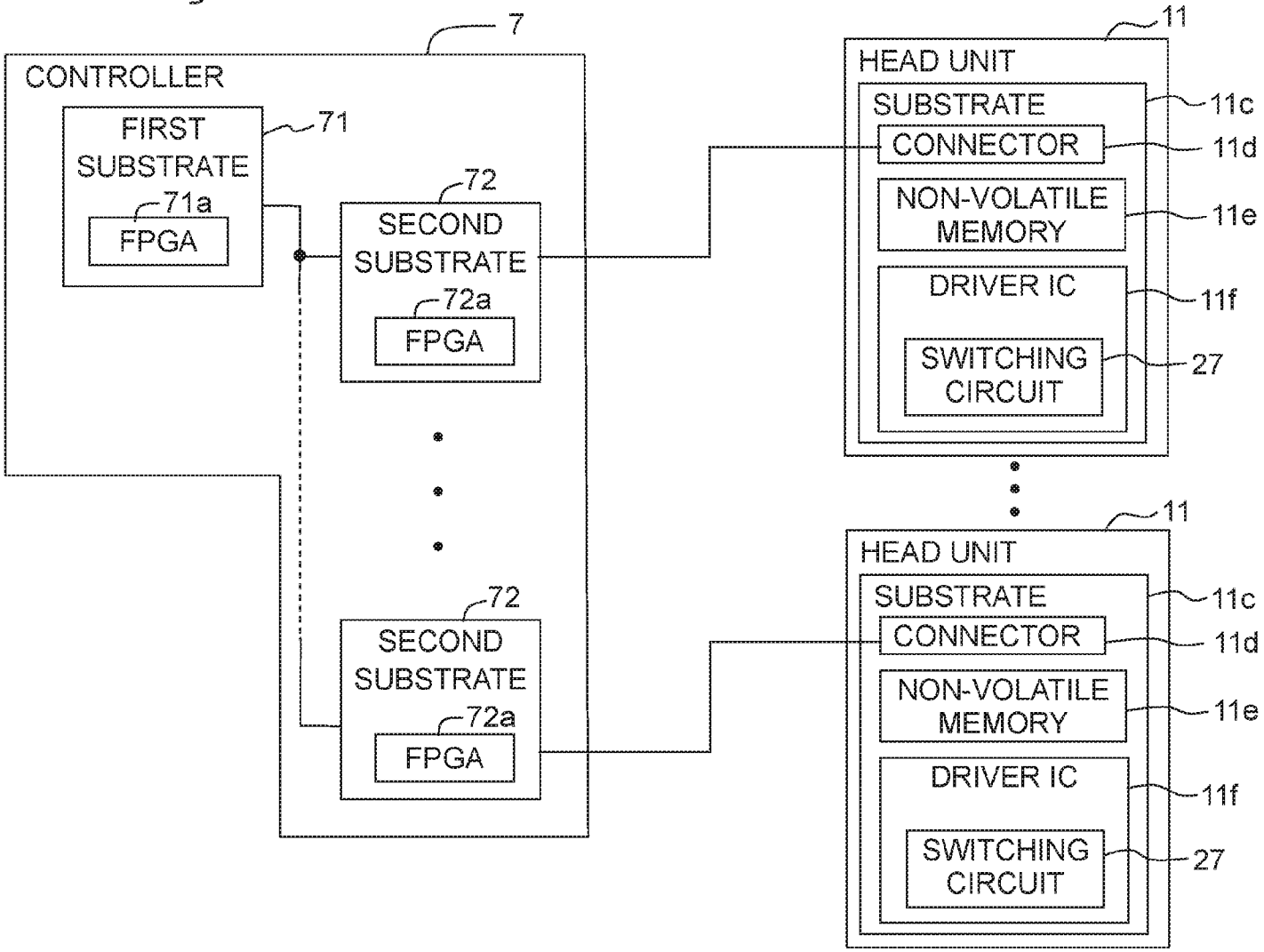
FIG. 4 is a block diagram schematically depicting connection of a controller and head units.

As depicted in FIG. 4, the controller 7 includes a first substrate 71 and a plurality of second substrates 72. The first substrate 71 is provided with the FPGA 71*a*. One second substrate 72 is provided with one FPGA 72*a*. The FPGA 71*a* is connected to the FPGAs 72*a* to control the driving of the FPGAs 72*a*. The second substrates 72, that is, the FPGAs 72*a* correspond respectively to the plurality of head units 11, and the number of the FPGAs 72*a* is the same as the number of head units 11. The FPGAs 72*a* are connected respectively with the head units 11. The FPGA 71*a* and the FPGAs 72*a* are connected to the ROM (not depicted) storing bit stream information and to the RAM (not depicted) as a memory.

Each of the head units 11 includes a substrate 11*c* on which a removable connector 11*d*, a non-volatile memory 11*e*, and a driver IC 11*f* are mounted. Each of the head units 11 is connected to one of the second substrates 72 in a removable manner via the connector 11*d*. Each of the driver ICs 11*f* includes a switching circuit 27 which will be described later on.

Figure 5:
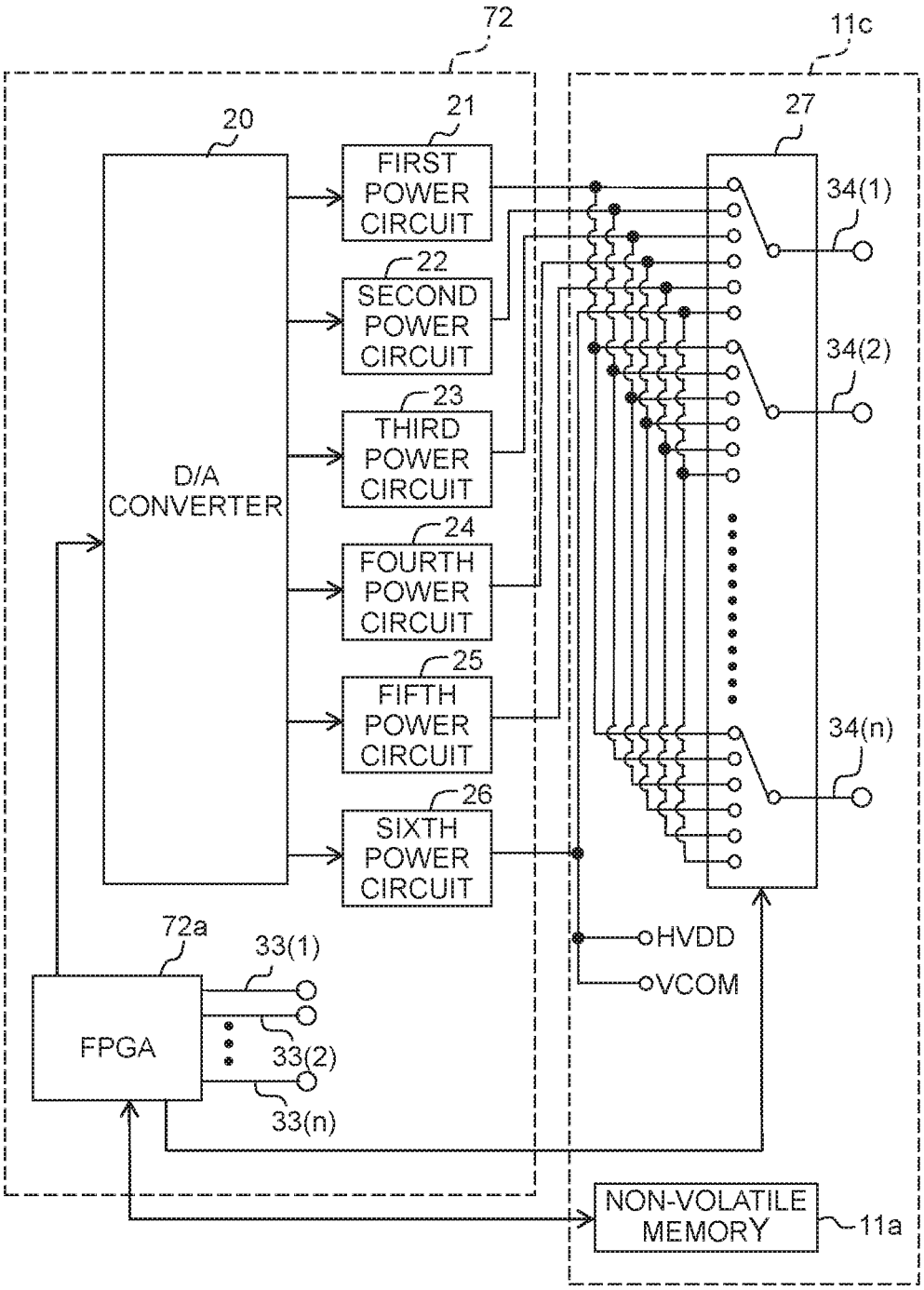
FIG. 5 is a block diagram schematically depicting a configuration in the vicinity of a power source.

As depicted in FIG. 5, the second substrate 72 is provided with a D/A (Digital/Analog) converter 20. Further, the second substrate 72 is provided with a plurality of power circuits and, particularly in this embodiment, is provide with a first power circuit 21 to a sixth power circuit 26. Each of the first power circuit 21 to the sixth power circuit 26 has an FET, impedance and the like, and output voltage thereof is changeable. As those first power circuit 21 to sixth power circuit 26, for example, switching-type DC/DC converters may be adopted. The FPGA 72*a* outputs a signal to the first power circuit 21 to the sixth power circuit 26 via the D/A converter 20, to set the output voltage.

The first power circuit 21 to the sixth power circuit 26 are connected to a first power wire 34(1) to an nth power wire 34(*n*) (n is a natural number not smaller than two) via the switching circuit 27. The switching circuit 27 connects each of the first power wire 34(1) to the nth power wire 34(*n*) to any of the first power circuit 21 to the sixth power circuit 26. The first power circuit 21 to the fourth power circuit 24 are ordinary power circuits which are ordinary used. The fifth power circuit 25 may be an ordinary power circuit or a standby power circuit while the sixth power circuit 26 is a power circuit of special specification. The sixth power circuit 26 is, for example, used for the highest rank of the drive voltages, or used concurrently as a power supply voltage for the VCOM of the actuators, or used for the nozzles 11*a* jetting the inks less easily, or used as an HVDD (the back gate voltage on the high side) of a PMOS transistor 31.

The HVDD voltage is connected to the sixth power circuit 26 whose output voltage is higher than the first power circuit 21 to the fifth power circuit 25 such that no electric current may flow in any parasitic diode of the PMOS transistor 31 on the high side even if a higher voltage is applied to a drain terminal 31*b* than to a source terminal 31*a* of the PMOS transistor 31.

Figure 6:
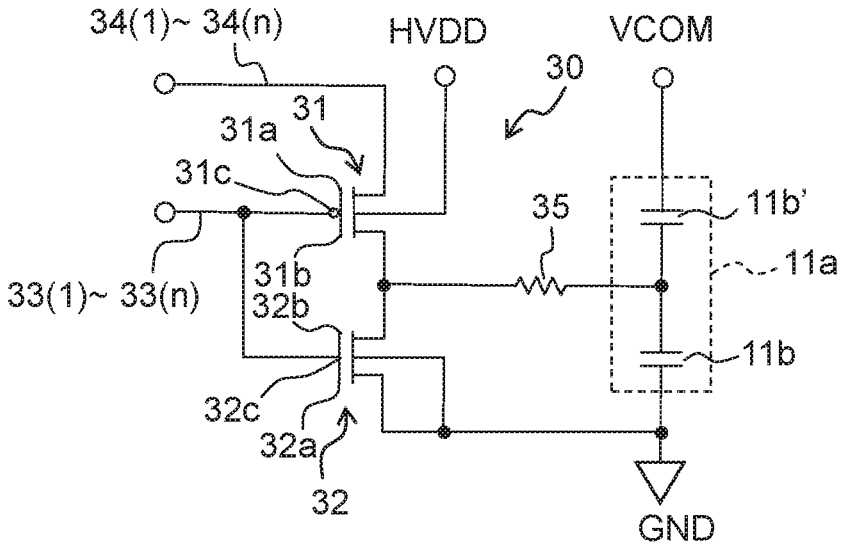
FIG. 6 is a circuit diagram schematically depicting a configuration of a CMOS (Complementary Metal-Oxide-Semiconductor) circuit to drive nozzles.

As depicted in FIG. 6, the printing apparatus 1 is provided with a plurality of CMOS circuits 30 to respectively drive the nozzles 11*a*. The FPGAs 72*a* output gate signals to the CMOS circuits 30 via a first control wire 33(1) to an nth control wire 33(*n*) (n is a natural number not smaller than two). Further, the first control wire 33(1) to the nth control wire 33(*n*) correspond to the first power wire 34(1) to the nth power wire 34(*n*). That is, the first control wire 33(1) corresponds to the first power wire 34(1), and the nth control wire 33(*n*) corresponds to the nth power wire 34(*n*).

The FPGA 72*a* outputs a signal to the switching circuit 27 to connect each of the first power wire 34(1) to the nth power wire 34(*n*) to any of the first power circuit 21 to the sixth power circuit 26. The FPGA 72*a* accesses the non-volatile memory 11*e* as necessary. The non-volatile memory 11*e* stores a plurality of nozzle addresses identifying the respective nozzles 11*a*, ranks corresponding to the nozzle addresses, and the like. The ranks will be described later on.

As depicted in FIG. 6, the CMOS circuit 30 includes the PMOS (P-type Metal-Oxide-Semiconductor) transistor 31, an NMOS (N-type Metal-Oxide-Semiconductor) transistor 32, an impedance 35, two piezoelectric bodies 11*b* and 11*b*', and the like. The piezoelectric bodies 11*b* and 11*b*' function as capacitors. Further, only the single piezoelectric body 11*b* may be provided. The source terminal 31*a* of the PMOS transistor 31 is connected to any of the first power wire 34(1) to the nth power wire 34(*n*). A source terminal 32*a* of the NMOS transistor 32 is grounded.

The drain terminals 31*b* and 32*b* of the PMOS transistor 31 and NMOS transistor 32 are connected to one end of the impedance 35. The other end of the impedance 35 is connected to the other end of the piezoelectric body 11*b*' on one hand and to one end of the piezoelectric body 11*b* on the other hand. The one end of the piezoelectric body 11*b*' on the one hand is connected to the VCOM voltage, that is, the sixth power supply voltage, whereas the other end of the piezoelectric body 11*b* on the other hand is grounded.

The PMOS transistor 31 and NMOS transistor 32 have gate terminals 31*c* and 32*c* connected to any of the first control wire 33(1) to nth control wire 33(*n*) corresponding to the power wires connected to the source terminal 31*a* of the PMOS transistor 31.

If an output signal "L" is inputted from the FPGA 72*a* to the gate terminals 31*c* and 32*c* of the PMOS transistor 31 and NMOS transistor 32, then the PMOS transistor 31 is conducted, the piezoelectric body 11*b* is charged, and the piezoelectric body 11*b*' is discharged. If an output signal "H" is inputted from the FPGA 72*a* to the gate terminals 31*c* and 32*c* of the PMOS transistor 31 and NMOS transistor 32, then the NMOS transistor 32 is conducted, the piezoelectric body 11*b* is discharged, and the piezoelectric body 11*b*' is charged. Charging and discharging the piezoelectric bodies 11*b* and 11*b*' cause the piezoelectric bodies 11*b* and 11*b*' to deform such that the inks are jetted from the nozzle 11*a*.

Figure 7:
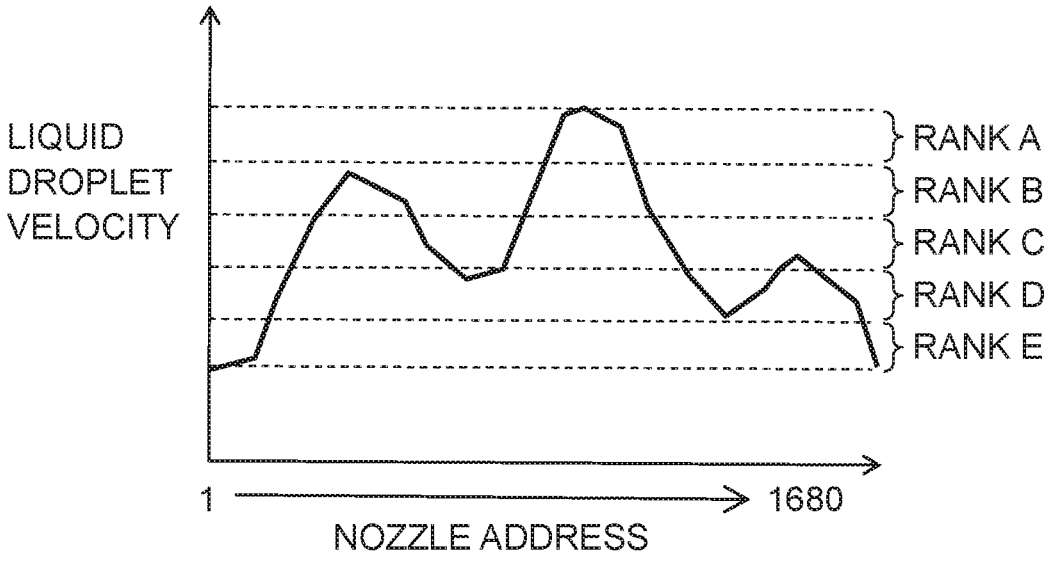
FIG. 7 is a graph depicting a relationship between a nozzle address identifying each nozzle and a velocity of liquid droplets (ink) jetted from each nozzle corresponding to the nozzle address when a certain voltage is applied to piezoelectric bodies.

The ranks of the nozzles 11*a* will be explained. FIG. 7 is a graph depicting a relationship between a nozzle address identifying each nozzle and a velocity of liquid droplets (ink) jetted from each nozzle 11*a* corresponding to the nozzle address when a certain voltage is applied to the piezoelectric bodies 11*b* and 11*b*'. There are, for example, 1680 nozzle addresses.

As depicted in FIG. 7, for example, the liquid droplet velocity is set in five velocity ranges to correspond to the rank A to the rank E, respectively. Further, the rank A corresponds to the highest velocity range whereas the rank E corresponds to the lowest velocity range. The non-volatile memory 11*e* stores the rank A to the rank E according to the liquid droplet velocity of each nozzle 11*a*, and the corresponding respective nozzle addresses. While the liquid droplet velocity is taken as an example here, it is possible to use the same concept for the jetting amount of liquid droplets.

Figures 8, 9:
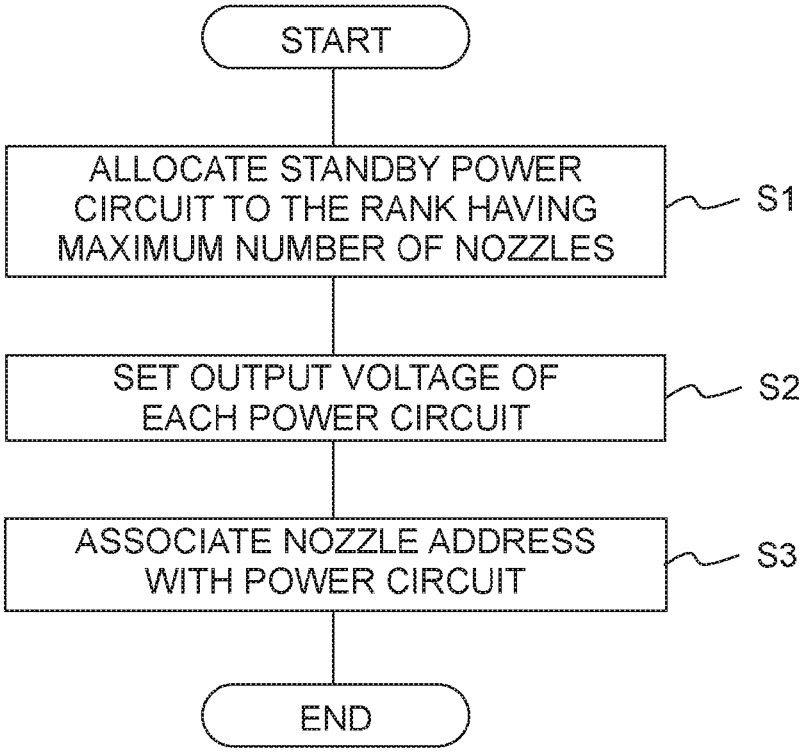
FIG. 8 is a conceptual diagram depicting an example of allocation table for power circuits.
FIG. 9 is a flowchart explaining a power circuit allocation process.

The non-volatile memory 11*e* of the head unit 11 stores such an allocation table as in FIG. 8, indicating an allocation of power circuits to the nozzles 11*a*. In FIG. 8, the column of the number of nozzles depicts the number of the nozzles 11*a* corresponding to the respective ranks, being preset in the non-volatile memory 11*e* according to each rank. The column of power source number depicts the power circuit number allocated to each rank. The column of drive voltage depicts the voltage for driving the nozzles 11*a* corresponding to each rank. In other words, the rank represents the magnitude of the voltage applied to the nozzles 11*a*.

The drive voltage serves for jetting the inks from the nozzles 11*a* at the targeted liquid droplet velocity, and is preset in the non-volatile memory 11*e* for each rank to suppress the difference in the liquid droplet velocity between the nozzles 11*a*. Further, the power source numbers 1 to 6 correspond respectively to the first power circuit 21 to the sixth power circuit 26.

The number of nozzles in each of the ranks A to E is calculated in advance with a method including actual measurement. The calculated number of nozzles is stored in a table in the non-volatile memory 11*e*. For example, as depicted in FIG. 8, the number of nozzles included in the ranks A to E are, respectively, 10, 350, 800, 500, and 20.

First, the power source number 6 is allocated to the rank E of the highest drive voltage. Further, in descending order of the number of nozzles, the ordinary power circuits, that is, the first power circuit 21 to the fourth power circuit 24, are allocated respectively to the ranks A to D. The power circuit number of the allocated power circuit is stored in the table. For example, as depicted in FIG. 8, the power source numbers 4, 3, 1, 2 and 6 are allocated respectively to the ranks A to E.

The FPGA 72*a* allocates the standby power circuit, that is, the fifth power circuit 25, to the rank having the maximum number of nozzles (step S1 in FIG. 9). The power circuit number of the allocated standby power circuit is stored in the table. For example, as depicted in FIG. 8, the power source number 5 is allocated in the rank C.

The FPGA 72*a* sets the output voltages of the first power circuit 21 to the sixth power circuit 26 to correspond to the drive voltages of the nozzles 11*a* corresponding to the ranks A to E (step S2 in FIG. 9). The FPGA 72*a* stores the nozzle addresses in the non-volatile memory 11*e* while associating each of the nozzle addresses with one of the first power circuit 21 to the sixth power circuit 26 (step S3 in FIG. 9), and then ends the process. The step S1 corresponds to the power circuit allocation process.

With respect to the printing apparatus according to the first embodiment, it is possible to appropriately allocate the first power circuit 21 to the sixth power circuit 26 to the respective ranks A to E so as to minimize the number of small power circuits in use and thus restrain the apparatus from growing in size. Further, by allocating the standby power circuit to the rank having the maximum number of nozzles, it is possible to minimize the number of the power circuits in use and thus restrain the apparatus from growing in size without adding ordinary power circuits.

In the first embodiment, at least two power circuits are allocated to supply the power to the rank associated with a large number of nozzles (actuators) and the difference between the jetting amount of liquid droplets and its target value is more likely to be conspicuous. Therefore, it is possible to secure a certain number or more of the ranks (four ranks or more in the first embodiment) of the drive voltages needed to adjust the variation of the nozzles in the jetting amount of liquid droplets. Further, the power circuits in use only have a small allowable power. The maximum number of nozzles which can be driven by the power circuits in use is ½ or less (⅓ in the first embodiment) of the number of all nozzles of the head unit 11. That is, the apparatus is restrained from growing in size by securing a certain number of the ranks for the necessary drive voltages while only using the minimum number of the required power circuits only having the small allowable power.

Without using any power circuits having a large allowable power capable of driving all the nozzles (actuators) included in the rank having the maximum number of nozzles, the standby power circuit is allocated to the rank, which has the maximum number of nozzles and in which the difference between the jetting amount of liquid droplets and its target value is more likely to be conspicuous. Therefore, it is possible to restrain the apparatus from growing in size by only using the power circuits having the small allowable power. A power circuit having a large allowable power needs to have not only large switching elements (MOSFET, for example), inductors, condensers, heat dissipation patterns for lost heat, and the like, but also a wide wiring range. As a result, the power circuit with the large allowable power grows in size, thereby causing the entire printing apparatus to grow in size if the power circuit with the large allowable power is used.

Second Embodiment

Figure 11:
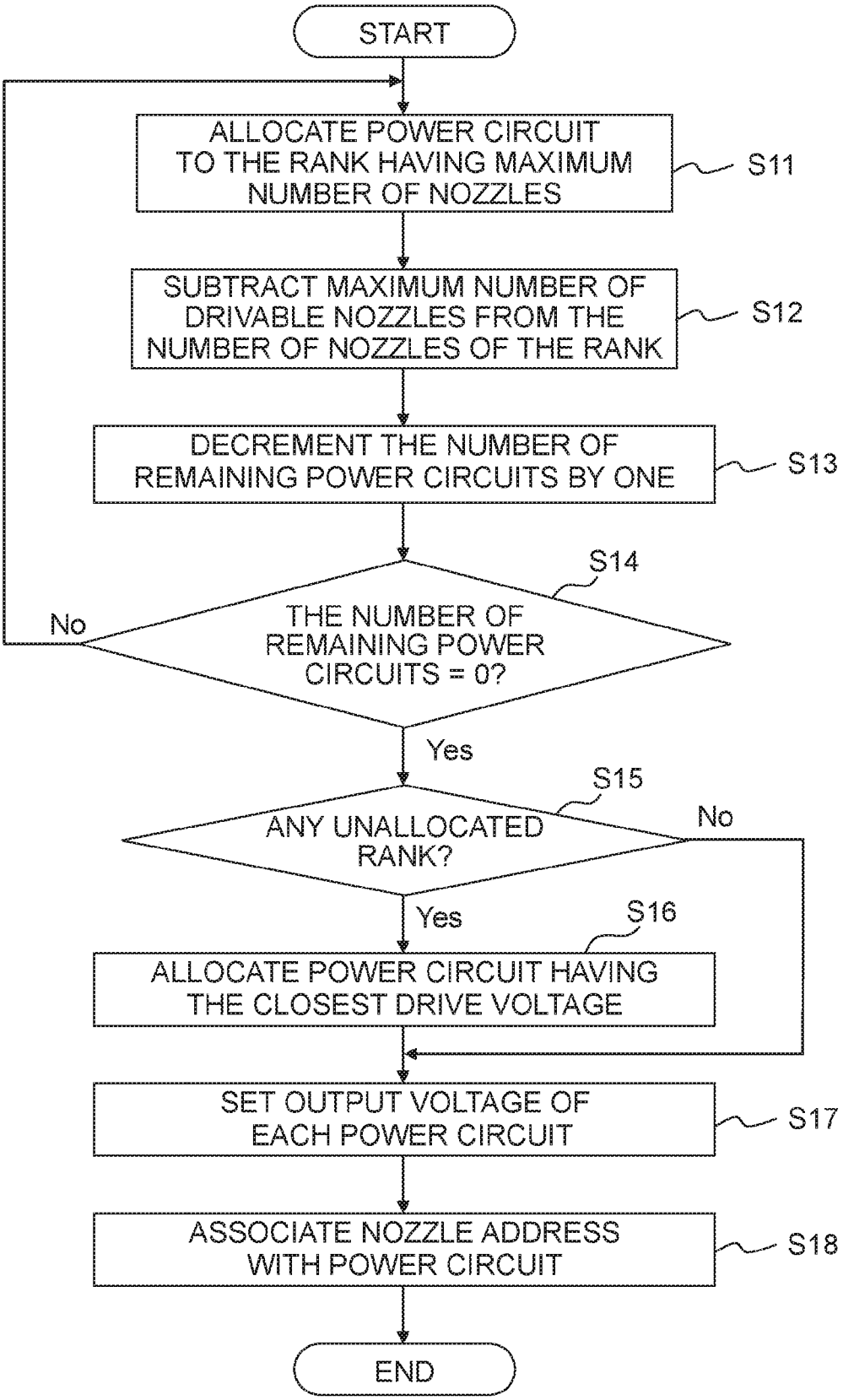
FIG. 11 is a flowchart explaining a power circuit allocation process in the second embodiment.
Figure 14A:
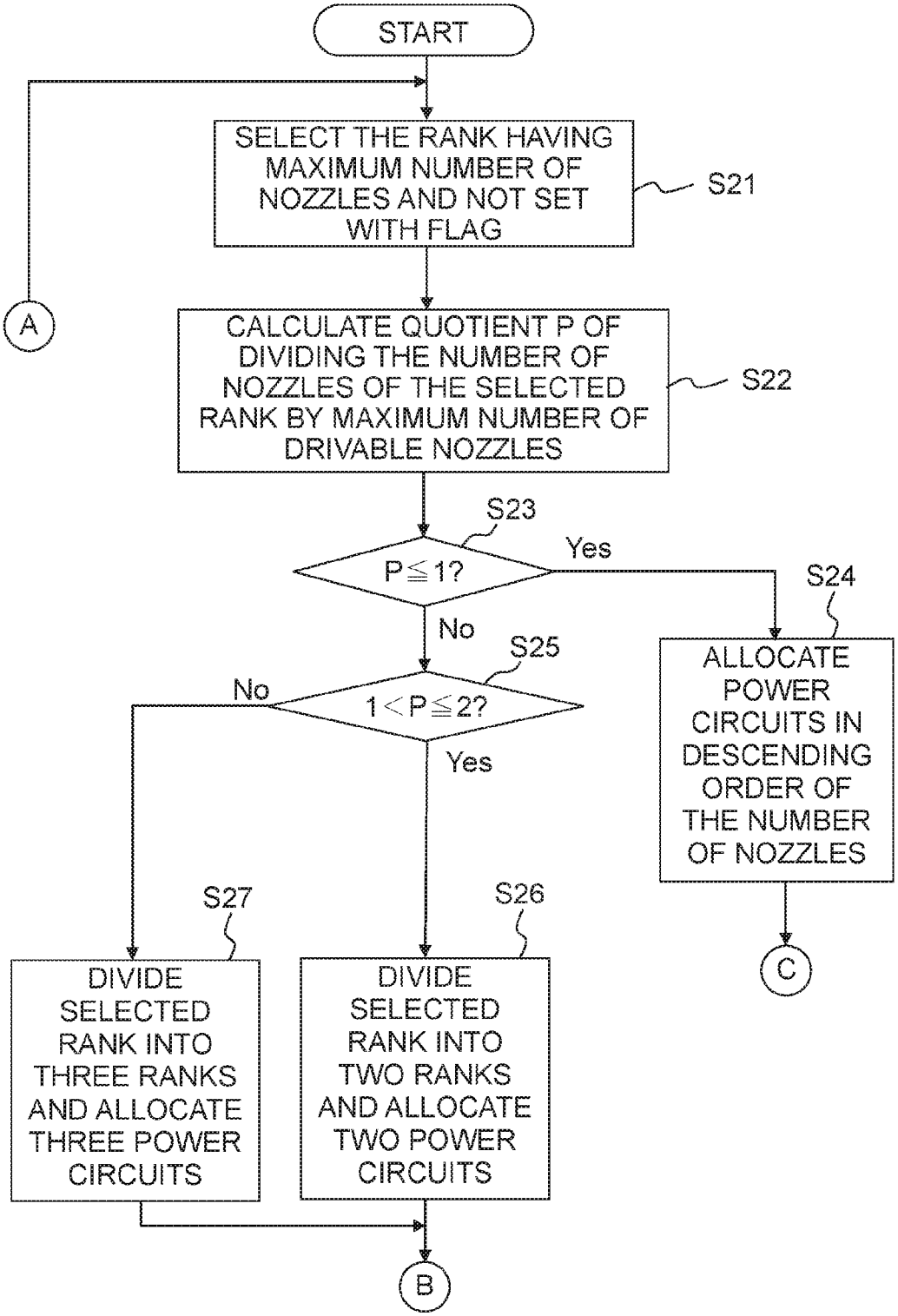
FIGS. 14A and 14B depict a flowchart explaining a power circuit allocation process in the third embodiment.
Figure 14B:
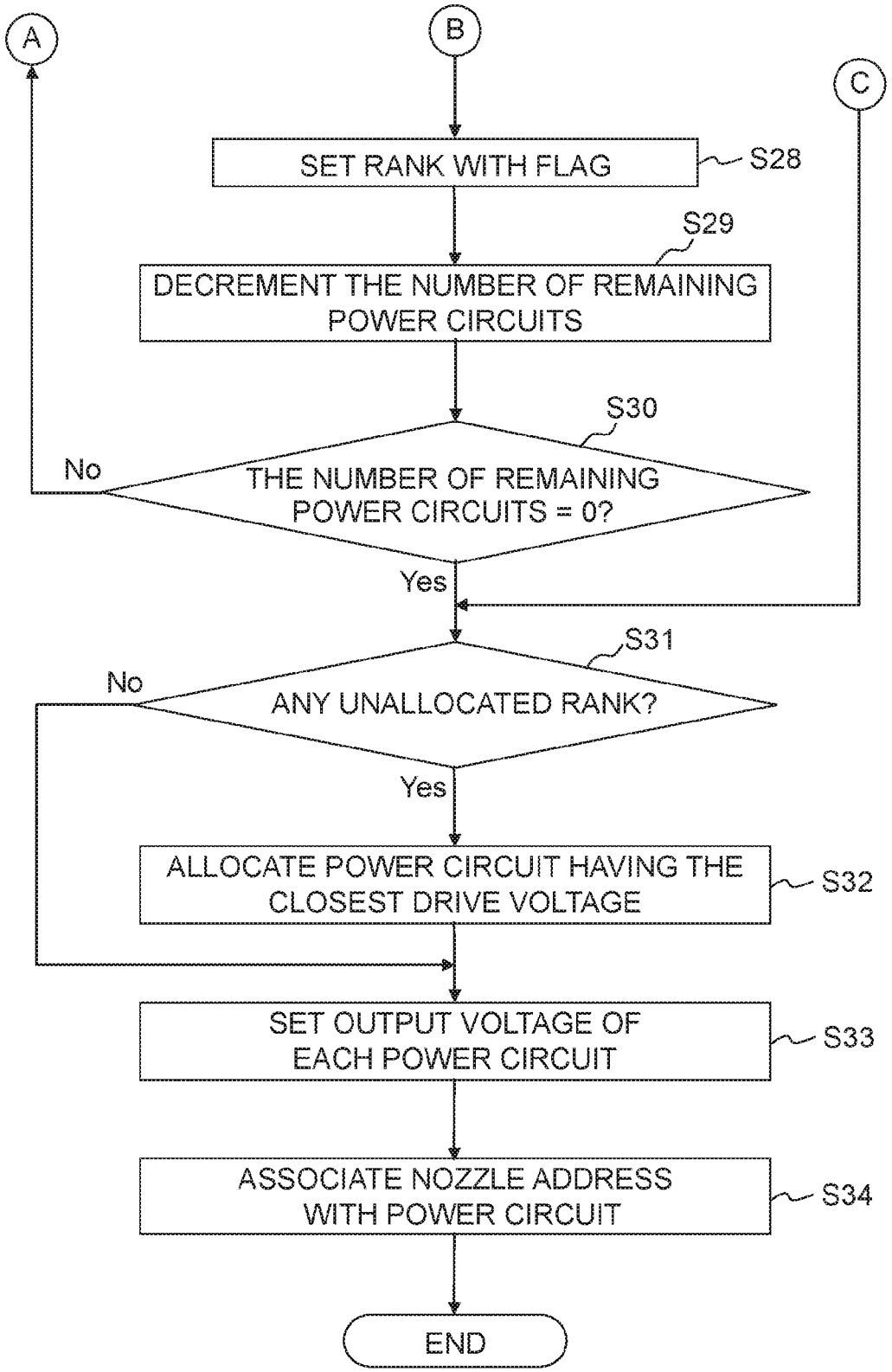

Referring to FIGS. 10 and 11, a printing apparatus according to a second embodiment will be explained below. Further, among the components according to the second embodiment, those identical or similar to the components of the first embodiment are assigned with the same reference signs, and any detailed explanation therefor is omitted. The non-volatile memory 11*e* stores the maximum number of the drivable nozzles with respect to each of the first power circuit 21 to the fifth power circuit 25. For example, the maximum number of the drivable nozzles for the first power circuit 21 to the fifth power circuit 25 is 560. Further, in the initial state, the non-volatile memory 11*e* stores the total number of the power circuits (5 in the second embodiment) as the number of remaining power circuits.

The number of nozzles in each of the ranks A to E is calculated in advance with a method including actual measurement. The calculated number of nozzles is stored in the table in the non-volatile memory 11*e*. For example, as depicted in FIG. 10, the numbers of nozzles included in the ranks A to E are, respectively, 5, 150, 870, 630, and 25. Further, the power source number 6 is allocated preliminarily to the rank E of the highest drive voltage, and stored in the table.

The FPGA 72*a* allocates an unallocated power circuit to the rank having the maximum number of nozzles among the ranks A to D (step S11). The power circuit number of the allocated power circuit is stored in the table. As depicted in FIG. 10, for example, the power source number 1 is allocated to the rank C. The FPGA 72*a* subtracts the maximum number of drivable nozzles of the allocated power circuit from the number of nozzles of the rank of the allocated power circuit (step S12). The FPGA 72*a* stores the number of nozzles after the subtraction in the non-volatile memory 11*e* as the number of nozzles of the rank of the allocated power circuit. As depicted in FIG. 10, for example, the maximum number of drivable nozzles 560 is subtracted from the number of nozzles 870 of the rank C, and the number 310 is stored as the number of the nozzles of the rank C. Further, the maximum number of drivable nozzles 560 is subtracted from the number of nozzles 630 of the rank D, and the number 70 is stored as the number of nozzles of the rank D.

The FPGA 72*a* decrements the number of remaining power circuits by one (step S13), and then determines whether the number of remaining power circuits is zero (step S14). If the number of remaining power circuits is not zero (step S14: No), then the FPGA 72*a* returns the process to the step S11. In the process of the step S11, the power circuit already allocated to a rank will not be allocated to any other rank. By virtue of this, the power circuits are allocated one by one to the respective ranks in descending order of the number of nozzles.

If the number of the remaining power circuits is zero (step S14: Yes), then the FPGA 72*a* determines whether there is any rank to which no power circuit is allocated (unallocated rank) (step S15). If there is any unallocated rank (step S15: Yes), then such a power circuit is allocated to the unallocated rank as having the closest drive voltage to the drive voltage of the unallocated rank (step S16). As depicted in FIG. 10, for example, if the rank A is an unallocated rank, then the fourth power circuit 24, which was allocated to the rank B, is allocated to the rank A because the fourth power circuit 24 has the closest drive voltage to the drive voltage of the rank A (step S16). In other words, the drive voltage for the nozzles 11*a* in the rank A is changed to the drive voltage for the nozzles 11*a* in the rank B.

The FPGA 72*a* sets the output voltages of the first power circuit 21 to the sixth power circuit 26 to correspond to the drive voltages of the nozzles 11*a* in the ranks A to E (step S17). The FPGA 72*a* stores the nozzle addresses in the non-volatile memory 11*e* while associating each of the nozzle addresses with one of the first power circuit 21 to the sixth power circuit 26 (step S18), and then ends the process. If there is no unallocated rank (step S15: No), then the FPGA 72*a* executes the step S17.

With respect to the printing apparatus according to the second embodiment, a plurality of small power circuits are allocated to the respective ranks in descending order of the number of nozzles. If there is any unallocated rank, then the power circuit having the closest drive voltage to the drive voltage of the unallocated rank is allocated to the unallocated rank, thereby minimizing the number of the small power circuits in use so as to suppress the growing of the printing apparatus in size.

By allocating a plurality of power circuits to the respective ranks in descending order of the number of nozzles, it is possible to allocate at least two or more power circuits to the rank, where the number of nozzles (actuators) is larger than or equal to a predetermined number and the difference between the jetting amount of liquid droplets and its target value is more likely to be conspicuous. On the other hand, if it is not possible to allocate the power circuits to all ranks, then such ranks are defined as unallocated ranks that there is a small number of nozzles and the difference between the jetting amount of liquid droplets and its target value is less likely to be conspicuous. It is possible to secure a certain number or more of the ranks (four ranks or more in this embodiment) of the drive voltages needed to adjust the variation of the jetting amount of liquid droplets of each nozzle by allocating the power circuit having the closest voltage to voltage of the unallocated rank to the unallocated rank. Further, by only using the minimum necessary number of the power circuits having the small allowable power, it is possible to suppress the growing of the printing apparatus in size.

Third Embodiment

Referring to FIGS. 12 to 14B, a printing apparatus according to a third embodiment will be explained below. Among the components according to the third embodiment, those identical or similar to the components of the first embodiment or the second embodiment are assigned with the same reference signs, and any detailed explanation therefor is omitted. In the initial state, all of the ranks are not set with aftermentioned flags. Further, in the initial state, the non-volatile memory 11*e* stores the total number of the power circuits (five in this embodiment) as the number of the remaining power circuits.

The number of nozzles in each of the ranks A to E is calculated in advance with a method including actual measurement. The calculated number of nozzles is stored in a table in the non-volatile memory 11*e*. For example, as depicted in FIG. 12, the numbers of nozzles of the ranks A to E are, respectively, 5, 150, 870, 630, and 25. Further, the power source number 6 is allocated preliminarily to the rank E of the highest drive voltage, and stored in the table.

From the ranks A to D, the FPGA 72*a* selects a rank having the maximum number of nozzles and being not set with the aftermentioned flag (step S21). As depicted in FIG. 12, for example, the rank C is selected, having the maximum number of nozzles 870 and being not set with the flag.

The FPGA 72*a* calculates the quotient P of dividing the number of nozzles of the selected rank (870 of the rank C, for example) by the maximum number of drivable nozzles (560, for example) (step S22). The FPGA 72*a* determines whether the quotient P is equal to or less than one (step S23). If the quotient P is more than one (step S23: No), then the FPGA 72*a* determines whether the quotient P is more than one but is equal to or less than two (step S25).

If the quotient P is more than one but is equal to or less than two (step S25: Yes), then the selected rank is divided by two and two power circuits are allocated respectively (step S26). The FPGA 72*a* sets the number of nozzles of each divided rank (the sub number of nozzles) to the half of the number of nozzles of the undivided rank. That is, the FPGA 72*a* divides the maximum number of nozzles and calculates the sub number of nozzles. The power circuit numbers of the allocated power circuits are stored in the table.

As depicted in FIG. 13, for example, because the quotient of dividing the number of nozzles 870 of the rank C by the maximum number of drivable nozzles 560 is about 1.55, the rank C is divided into a rank C1 and a rank C2, and a power circuit is allocated to each of the rank C1 and the rank C2. The number of nozzles of each of the divided rank C1 and rank C2 is the half of the number of nozzles 870 of the undivided rank C, that is, 435.

Likewise, the rank D is also divided into a rank D1 and a rank D2, and the number of nozzles of each of the divided ranks (the second sub number of nozzles) is the half of the number of nozzles 630 of the undivided rank, that is, 315. Then, two power circuits are allocated respectively. Further, the number of nozzles of the divided rank (the sub number of nozzles or the second sub number of nozzles) is not limited to the equally divided number of nozzles of the undividedrank.

Each of the divided ranks is set with a flag indicating the allocation of the power circuit (step S28), and the number of allocated power circuits is subtracted from the number of remaining power circuits (step S29). For example, the ranks C1 and C2 are set with the flags, and thus two is subtracted from the remaining power circuits.

If the quotient P is more than two (step S25: No), that is, if the quotient P is larger than two, then the FPGA 72*a* divides the selected rank into three ranks, allocates three power circuits respectively to the same (step S26), and executes the step S28.

The FPGA 72*a* determines whether the number of remaining power circuits is zero (step S30). If the number of remaining power circuits is not zero (step S30: No), then the FPGA 72*a* returns the process to the step S21. If the number of remaining power circuits is zero (step S30: Yes), then the FPGA 72*a* determines whether there is any rank without allocated power circuit (unallocated rank) (step S31).

If there is any unallocated rank (step S31: Yes), then the FPGA 72*a* allocates, to the unallocated rank, the power circuit allocated to the rank having the closest drive voltage to the drive voltage of the unallocated rank (step S32). As depicted in FIG. 13, for example, if the rank A is an unallocated rank, then the fifth power circuit 25, which is already allocated to the rank B having the closest drive voltage to the drive voltage of the rank A, is allocated to the rank A. In other words, the drive voltage of the rank A is changed to the drive voltage of the rank B.

The FPGA 72*a* sets the output voltages of the first power circuit 21 to the sixth power circuit 26 to correspond to the drive voltages of the nozzles 11*a* corresponding to the ranks A to E (step S33). The FPGA 72*a*, stores the nozzle addresses in the non-volatile memory 11*e* while associating each of the nozzle addresses with one of the first power circuit 21 to the sixth power circuit 26 (step S34), and then ends the process.

In the step S23, if the quotient P is equal to or less than one (step S23: Yes), then the first power circuit 21 to the fifth power circuit 25 are allocated to the ranks A to D in descending order of the number of nozzles (step S24), and the process proceeds to the step S31.

In the step S31, if there is no unallocated rank (step S31: No), then the FPGA 72*a* executes the step S33.

In the third embodiment, although the upper limit of the number of divided ranks is three in the steps S23 to S27, the upper limit may not be set. For example, n may be sought within the range $1<P\leq n$ (n is a natural number not smaller than two) to divide a rank by n. The upper limit of the dividing number is set as appropriate in consideration of the number of power circuits, the maximum number of drivable nozzles, the maximum number of nozzles among ranks, and the like.

With respect to the printing apparatus according to the third embodiment, the maximum number of nozzles is divided to calculate the sub number of nozzles, and a plurality of small power circuits are allocated to the respective ranks in descending order of the number of nozzles and the sub number of nozzles. Further, the power circuit having the closest voltage to the voltage of an unallocated rank is allocated to the unallocated rank. By virtue of this, it is possible to minimize the number of the small power circuits in use so as to suppress the growing of the printing apparatus in size.

By allocating, to the unallocated rank, the power circuit having the closest voltage to the voltage of the unallocated rank, at least two or more power circuits are allocated for supplying the power to the rank, where the number of nozzles (actuators) is equal to or larger than the predetermined number and the difference between the jetting amount of liquid droplets and its target value is more likely to be conspicuous. On the other hand, if it is not possible to allocate power circuits to all ranks, then such ranks are defined as unallocated ranks that there is a small number of nozzles and the difference between the jetting amount of liquid droplets and its target value is less likely to be conspicuous. It is possible to secure a certain number or more of the ranks (four ranks or more in this embodiment) of the drive voltages needed to adjust the variation of the jetting amount of liquid droplets of each nozzle by allocating, to the unallocated rank, the power circuit having the closest voltage to voltage of the unallocated rank. Further, by only using the minimum necessary number of the power circuits having a small allowable power, it is possible to suppress the growing of the printing apparatus in size.

As necessary, for the next largest number of nozzles to the maximum number of nozzles, the second sub number of nozzles may be calculated and, in descending order of the number of nozzles, the sub number of nozzles and the second sub number of nozzles, a plurality of small power circuits may be allocated to the respective ranks. It is possible to minimize the number of the small power circuits in use, thereby suppressing the growing of the printing apparatus in size.

By allocating a plurality of power circuits to the respective ranks in descending order of the number of nozzles, sub number of nozzles and second sub number of nozzles, it is possible to allocate at least two or more power circuits for supplying the power to all of the ranks, where the number of nozzles (actuators) is equal to or larger than a predetermined number and the difference between the jetting amount of liquid droplets and its target value there is more likely to be conspicuous. Thus, by only using the power circuits having a small allowable power, it is possible to suppress the growing of the printing apparatus in size.

Fourth Embodiment

Referring to FIGS. 15 to 18B, a printing apparatus according to a fourth embodiment will be explained below. Among the components according to the fourth embodiment, those identical or similar to the components of the first embodiment to the third embodiment are assigned with the same reference signs, and any detailed explanation therefor is omitted. The non-volatile memory 11*e* stores the maximum (predetermined) number of drivable nozzles for each of the first power circuit 21 to the sixth power circuit 26. For example, the maximum number of drivable nozzles is 560 for each of the first power circuit 21 to the fifth power circuit 25. Further, the non-volatile memory 11*e* stores the maximum number of power circuits allocatable to a single rank (the maximum allocation number), such as 2, for example.

In the initial state, all of the ranks are not set with the aftermentioned flags. Further, in the initial state, the non-volatile memory 11*e* stores the total number of power circuits (five in this embodiment) as the number of remaining power circuits.

The number of nozzles in each of the ranks A to E is calculated in advance with a method including actual measurement. The calculated numbers of nozzles of the ranks A to E are stored in the non-volatile memory 11*e*. For example, as depicted in FIG. 15, the numbers of nozzles of the ranks A to E are, respectively, 7, 150, 1200, 300, and 23. Further, the power source number 6 is allocated preliminarily to the rank E of the highest drive voltage, and stored in the table.

The FPGA 72*a* selects a rank (maximum rank) having the largest number of nozzles associated therewith and being not set with the aftermentioned flag from the ranks A to D (step S41). As depicted in FIG. 15, for example, the rank C is selected, having the maximum number of nozzles 1200 and being not set with the flag.

The FPGA 72*a* allocates a power circuit to the selected rank (step S42). The power circuit number of the allocated power circuit is stored in the table. As depicted in FIG. 16, for example, the power source number 1 is stored for the rank C. The FPGA 72*a* subtracts the maximum number of drivable nozzles of the allocated power circuit from the number of nozzles of the rank to which the power circuit is allocated (step S43), and stores the subtracted result in the non-volatile memory 11*e* as the number of nozzles of that rank.

For example, the maximum number of drivable nozzles 560 of the first power circuit 21 is subtracted from the number of nozzles 1200 of the rank C, and stores the subtracted result 640 in the non-volatile memory 11*e* (see FIG. 16). The FPGA 72*a* decrements the number of remaining power circuits by one (step S44), and determines whether the number of power circuits allocated to the selected rank has reached the maximum allocation number (step S45). For example, it is determined whether the number of power circuits allocated to the rank C has reached two.

If it is determined that the number of the power circuits allocated to the selected rank has not reached the maximum allocation number (step S45: No), then the FPGA 72*a* determines whether the number of remaining power circuits is zero (step S47). If the number of remaining power circuits is not zero (step S47: No), then the FPGA 72*a* returns the process to the step S41.

For example, if only one power circuit is allocated to the rank C, then the number of remaining power circuits is four but not zero. Thus, the process is returned to the step S41. On this occasion, because the rank C is not set with the aftermentioned flag, the process is carried out from the step S41 with the number of nozzles 640 in the rank C. That is, the FPGA 72*a* carries out the process from the step S41 with the numbers of nozzles in the ranks A to D being, respectively, 7, 150, 640, and 300.

If it is determined that the number of power circuits allocated to the selected rank has reached the maximum allocation number (step S45: Yes), then the FPGA 72*a* sets the selected rank with the flag indicating completion of allocating the power circuits (step S46), and carries out the step S47. As depicted in FIG. 16, for example, when two power circuits are allocated to the rank C, the rank C is set with the flag. Thereafter, when the process is returned to the step S41, the rank C set with the flag will not be selected.

That is, in the step S41, the FPGA 72*a* selects a rank having the maximum number of nozzles from the ranks A, B, and D.

If the second power circuit is allocated to the rank C in the step S42, then in the step S43, the FPGA 72*a* subtracts the maximum number of drivable nozzles 560 of the first power circuit 21 from the number of nozzles 640 of the rank C, and the subtracted result 80 is stored in the non-volatile memory 11*e*.

If the number of remaining power circuits is zero (step S47: Yes), then the FPGA 72*a* determines whether the subtracted number of nozzles exceeds zero in the rank set with the flag (step S48). If the subtracted number of nozzles exceeds zero (step S48: Yes), then the FPGA 72*a* divides the subtracted number of nozzles to allocate the same to another rank (step S49).

As depicted in FIG. 16, for example, in the rank C set with the flag, the number of nozzles after the subtraction is 80, exceeding zero. In this case, as depicted in FIG. 17, the number of nozzles 80 after the subtraction is equally divided to allocate 40 to each of the rank B and the rank D having the closest drive voltage to the drive voltage of the rank C. That is, among the nozzles 11*a* in the rank C, 40 nozzles 11*a* are changed to the rank B while the other 40 nozzles 11*a* are changed to the rank D. The number of nozzles of the rank C is changed from 1200 to 1120, the number of nozzles of the rank B is changed from 150 to 190, and the number of nozzles of the rank D is changed from 300 to 340.

The difference between the drive voltage of the rank C and the drive voltage of each of the rank B and the rank D is set to be not higher than a predetermined value such as not higher than 1.0[V]. That is, the number of nozzles 80 after the subtraction in the rank C (rank of maximum number of nozzles) is allocated to the ranks B and D (other ranks) whose voltage differences from the drive voltage of the rank C are not higher than the predetermined value.

The FPGA 72*a* sets the output voltages of the first power circuit 21 to the sixth power circuit 26 to correspond to the drive voltages of the nozzles 11*a* in the ranks A to E (step S50). The FPGA 72*a* stores the nozzle addresses in the non-volatile memory 11*e* while associating each of the nozzle addresses with one of the first power circuit 21 to the sixth power circuit 26 (step S51), and then ends the process. Further, in the step S48, if the number of nozzles after the subtraction does not exceed zero (step S48: No), then the FPGA 72*a* executes the step S50.

With respect to the printing apparatus according to the fourth embodiment, the power circuits not more than the maximum allocation number (two, for example) are allocated to the rank of maximum number of nozzles (the rank C, for example) while the power circuits less than the maximum allocation number are allocated to other ranks. If the number of nozzles in the rank of maximum number of nozzles exceeds the total number of maximum number of drivable nozzles (a predetermined number) of the allocated one or plurality of power circuits, then the same number of nozzles 11*a* as the number of subtracting the total number from the number of nozzles in the rank of maximum number of nozzles are allocated to the other ranks whose voltage difference from the voltage of the power circuit corresponding to the rank of maximum number of nozzles is not higher than the predetermined value. By virtue of this, the number of small power circuits in use is minimized to suppress the growing of the printing apparatus in size. By the allocation described above, the difference between the jetting amount of liquid droplets and its target value is made as less conspicuous as possible. Hence, it is possible to secure a certain number or more of the ranks (four or more ranks in this embodiment) of the drive voltages needed to adjust the variation of the respective nozzles in the jetting amount of liquid droplets. Further, by only using the minimum necessary number of the power circuits having a small allowable power, it is possible to suppress the growing of the printing apparatus in size.

Fifth Embodiment

Figure 18A:
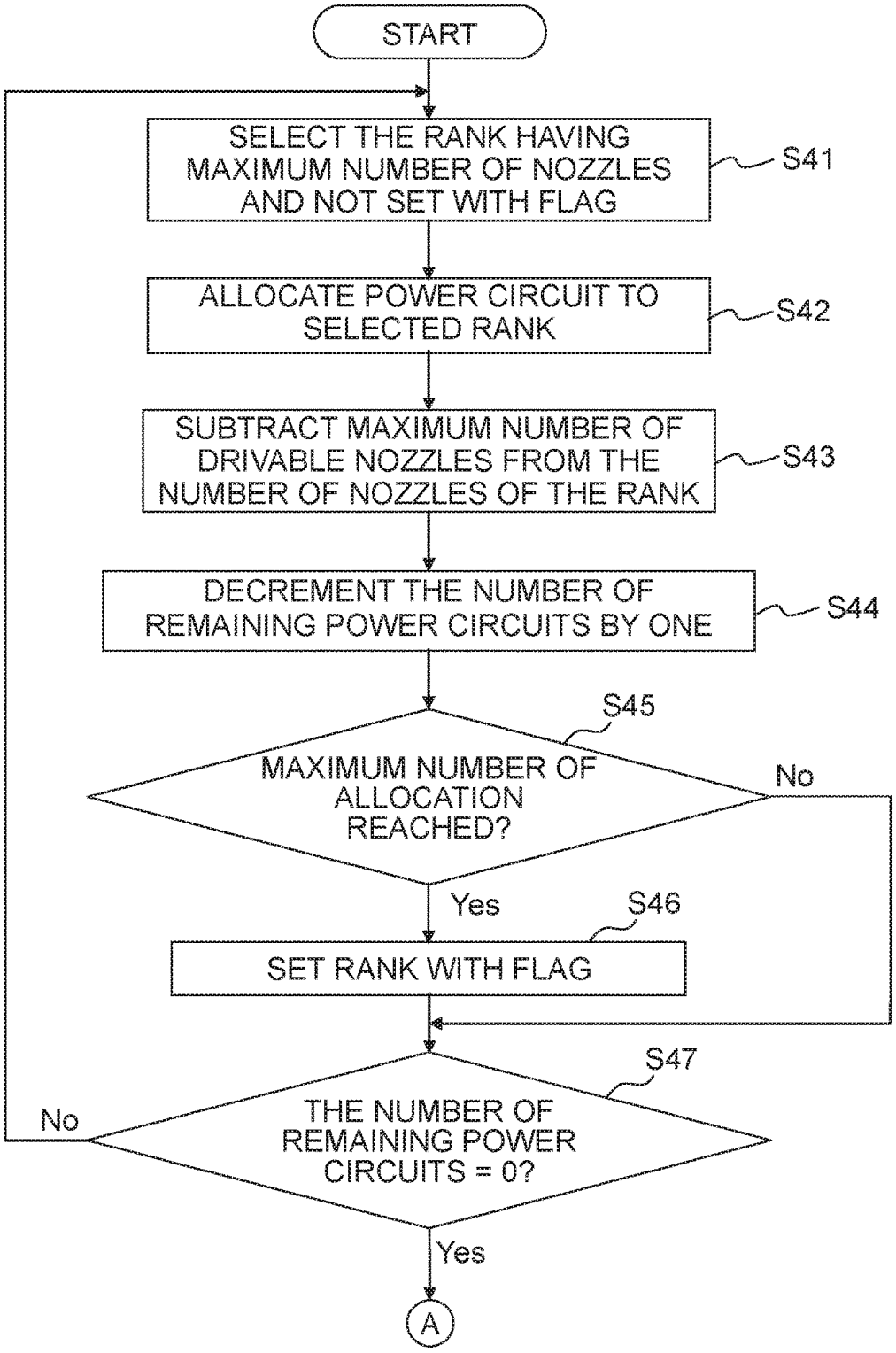
FIGS. 18A and 18B depict a flowchart explaining a power circuit allocation process in the fourth embodiment.
Figures 18B, 19:
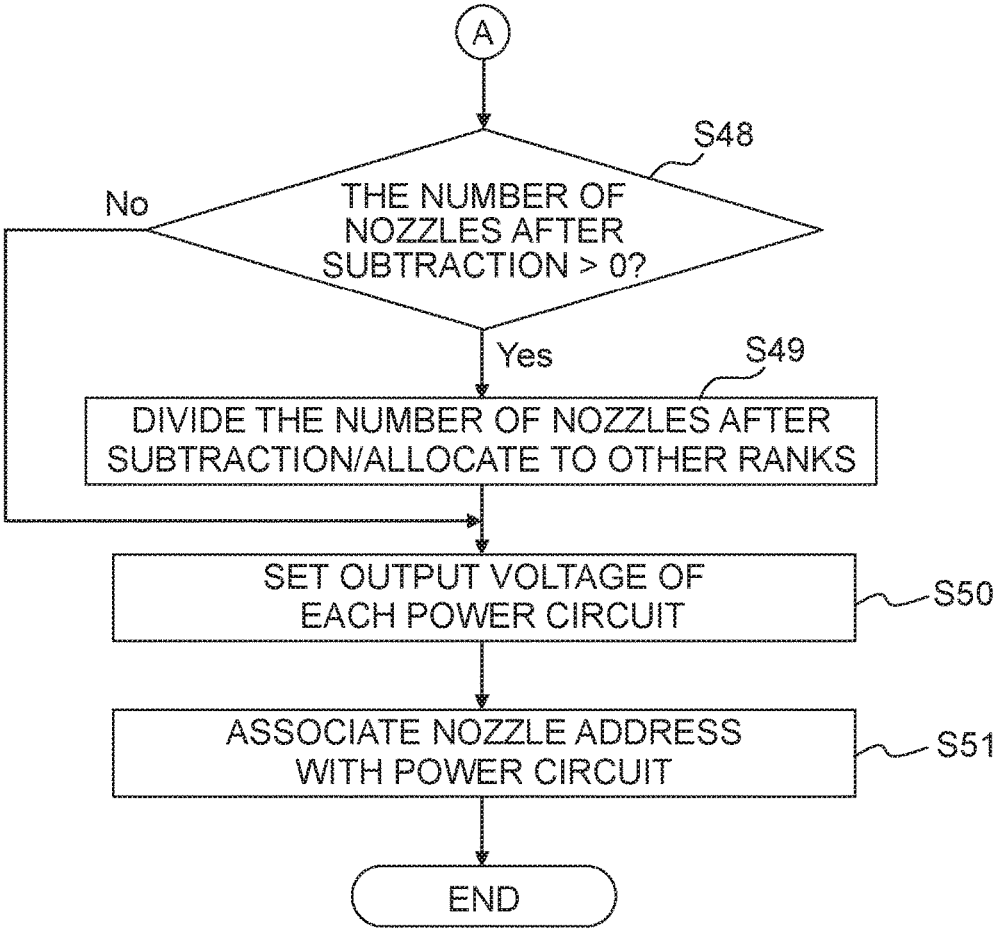
FIG. 19 is a table depicting a relationship between the maximum number of driven nozzles and the drive voltage of a power circuit in a printing apparatus according to a fifth embodiment.

Referring to FIG. 19, a printing apparatus according to a fifth embodiment will be explained below. Among the components according to the fifth embodiment, those identical or similar to the components of the first embodiment to the fourth embodiment are assigned with the same reference signs, and any detailed explanation therefor is omitted. For example, let X be the maximum number of drivable nozzles of the first power circuit 21 to the third power circuit 23, and Y be the maximum number of drivable nozzles of the fourth power circuit 24 to the sixth power circuit 26, where Y is ¾ of X. That is, such a relation stands as Y=X*3/4.

As depicted in FIG. 19, the higher the drive voltage, the smaller the maximum number of drivable nozzles for one power circuit. Therefore, in the fifth embodiment, according to the drive voltage, the maximum numbers of drivable nozzles of the first power circuit 21 to the sixth power circuit 26 are changed. The maximum numbers of drivable nozzles of the first power circuit 21 to the sixth power circuit 26 are not limited to satisfying the above relation between X and Y, and may be set appropriately according to the specification of the printing apparatus.

The maximum number of drivable nozzles varies with not only the drive voltage but also the number of times of driving the nozzles 11*a* per unit time (the drive frequency) or temperature and the like. Hence, the maximum number of drivable nozzles of the first power circuit 21 to the sixth power circuit 26 may be changed according to the drive frequency or the temperature and the like.

Sixth Embodiment

Figure 20:
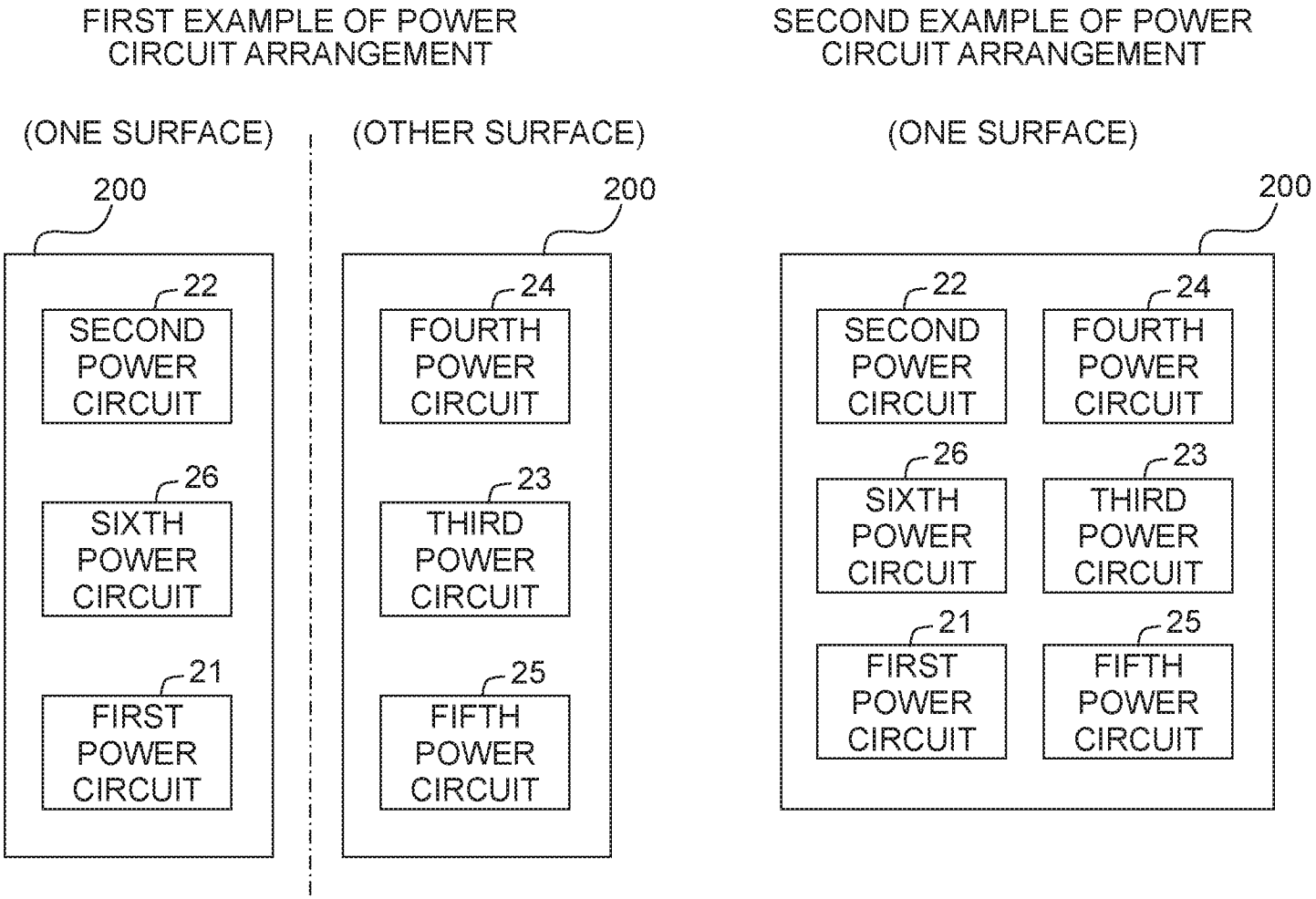
FIG. 20 is an explanatory diagram explaining an arrangement of power circuits in a printing apparatus according to a sixth embodiment.

Referring to FIG. 20, a printing apparatus according to a sixth embodiment will be explained below. Among the components according to the sixth embodiment, those identical or similar to the components of the first embodiment to the fifth embodiment are assigned with the same reference signs, and any detailed explanation therefor is omitted. Let L be the maximum number of drivable nozzles (a predetermined number) of the first power circuit 21 to the third power circuit 23, and M be the maximum number of drivable nozzles of the fourth power circuit 24 to the sixth power circuit 26. Further, M is smaller than L. Generally, the larger the maximum number of drivable nozzles, the larger the heat of the power circuit. One of a group of the first power circuit 21 to the third power circuit 23 and another group of the fourth power circuit 24 to the sixth power circuit 26 constitutes a first number of power circuits, whereas the other constitutes a second number of power circuits.

As depicted in a first example of power circuit arrangement of FIG. 20, the first power circuit 21 and the second power circuit 22 are juxtaposed on one surface of a substrate 200 and the sixth power circuit 26 is arranged between the first power circuit 21 and the second power circuit 22. The fourth power circuit 24 and the fifth power circuit 25 are juxtaposed on the other surface of the substrate 200 and the third power circuit 23 is arranged between the fourth power circuit 24 and the fifth power circuit 25. Further, the fifth power circuit 25, the third power circuit 23, and the fourth power circuit 24 are positioned respectively on the back sides of the first power circuit 21, the sixth power circuit 26, and the second power circuit 22.

The first power circuit 21 to the sixth power circuit 26 may be arranged as depicted in a second example of power circuit arrangement of FIG. 20. That is, the power circuits of the maximum number of drivable nozzles L (the first power circuit 21 to the third power circuit 23) and the power circuits of the maximum number of drivable nozzles M (the fourth power circuit 24 to the sixth power circuit 26) are arranged alternately on one surface of the substrate 200 in a staggered form.

With respect to the printing apparatus according the sixth embodiment, by alternately arranging the first power circuit 21 to the third power circuit 23 and the fourth power circuit 24 to the sixth power circuit 26 which are different in the maximum number of drivable nozzles, it is possible, for example, to average the heat generated by the power circuits.

Seventh Embodiment

Figure 22:
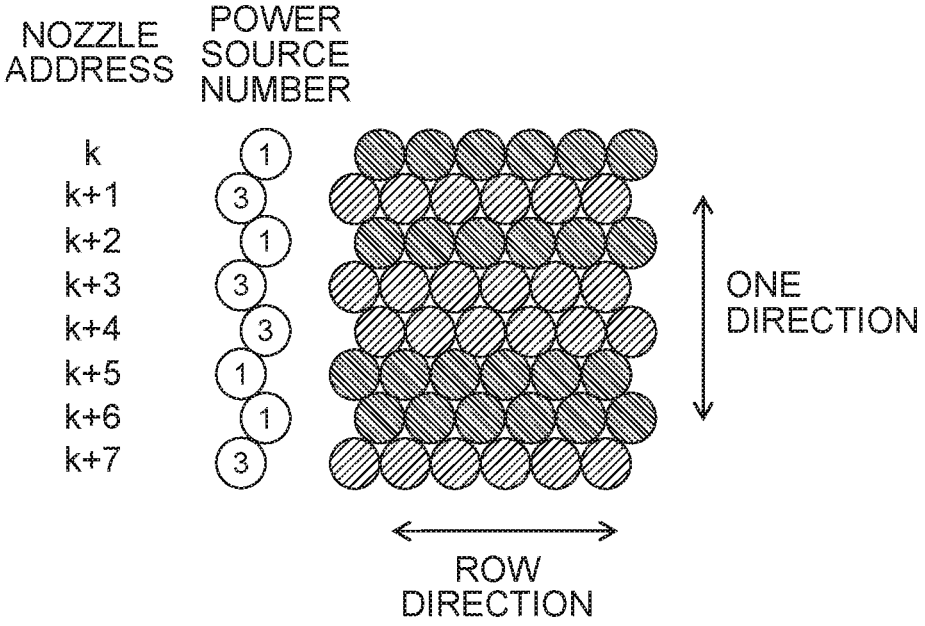
FIG. 22 is an explanatory diagram explaining the power source number and an arrangement of nozzles driven by a plurality of power circuits having the same drive voltage.

Referring to FIGS. 21 and 22, a printing apparatus according to a seventh embodiment will be explained below. As depicted in FIG. 22, each nozzle address indicates the position of a row of the nozzles 11*a* in one direction orthogonal to the row direction.

As depicted in FIG. 10, for example, if the first power circuit 21 and the third power circuit 23 are allocated to the rank C and if the nozzle addresses of the rank C are consecutive, then the first power circuit 21 and the third power circuit 23 are allocated such that the number of times (a consecutive number) of consecutively allocating the first power circuit 21 and the third power circuit 23 to those consecutive nozzle addresses may be equal to or less than a second predetermined number (two, for example) (see FIG. 21). That is, the first power circuit 21 and the third power circuit 23 are allocated to the consecutive rows of the nozzles 11*a* such that the consecutive number of the first power circuit 21 and the third power circuit 23 may be equal to or less than the second predetermined number (see FIG. 22). The first power circuit 21 and the third power circuit 23 may be allocated alternately one after another to the nozzle addresses of the rank C, such that the first power circuit 21 and the third power circuit 23 are allocated inconsecutively to the rows of the plurality of nozzles 11*a*.

If the same power circuit is allocated consecutively to a plurality of rows up to a predetermined number or more, then in the case of switching to another power circuit of the same applying voltage, density variation is liable to occur in the switched places. For example, after allocating the first power circuit 21 to three or more rows, if the third power circuit 23 is allocated to three or more rows, then the density variation is liable to occur in the border between the rows of the allocated first power circuit 21 and the rows of the allocated third power circuit 23.

In the seventh embodiment, if a plurality of power circuits of the same applying voltage are allocated to a plurality of rows of the nozzles 11*a* juxtaposed in one direction, then the plurality of power circuits of the same applying voltage are allocated to the plurality of rows such that either the identical power circuits are inconsecutive or the number of consecutive identical power circuits is equal to or less than a predetermined number (two, for example). By virtue of this, it is possible to suppress the density variation in the places of switching the power circuits in use.

If either the identical power circuits are inconsecutive or the number of consecutive identical power circuits is equal to or less than a predetermined number (two, for example) for a plurality of rows, then the density is averaged such that the density variation is less visible.

Eighth Embodiment

It is possible to carry out the processes described above also in a printing apparatus system including a printing apparatus and an external device. That is, as depicted in FIG. 1, a control program recorded in a recording medium 150 may be installed in the external device 9. The external device 9 includes a CPU (Central Processing Unit), a ROM, a RAM, a non-volatile memory, and the like. Based on the installed control program, the CPU of the external device 9 accesses the non-volatile memory 11*e* of the head unit 11 to acquire necessary data, and carries out the processes according to the first embodiment to the fifth embodiment or the seventh embodiment. The necessary data may be stored in the non-volatile memory of the external device 9 if the control program is installed.

In the respective embodiments described above, the FPGAs 71*a* and 72*a* are used. Instead of the FPGAs 71*a* and 72*a*, however, a processor such as a CPU or the like may be used. Further, the FPGAs 72*a* of the second substrates 72 may not be provided. In this case, the FPGA 71*a* sets the output voltages of the first power circuit 21 to the sixth power circuit 26, outputs the gate signals to the first control wire 33(1) to the nth control wire 33(*n*), and carries out the control of switching the switching circuit 27.

In the respective embodiments described above, the connector 11*d* is configured to be removable. Therefore, it is possible to select the head units 11 where the non-volatile memories 11*e* have stored the specification of the second substrates 72 such as the data according to the output voltages of the power circuits and the number of the power circuits, and to connect the same to the second substrates 72.

It should be considered that the embodiments disclosed above are exemplary in each and every aspect but not limitary. It is possible to combine the technical characteristics with one another set forth in the respective embodiments. The scope of each of the embodiments is intended to include all changes and modifications within the scope of the appended claims, and a scope equivalent to the scope of the appended claims.

What is claimed is:

1. A printing apparatus comprising:

actuators configured to exert force to liquid;

power circuits configured to apply voltages to the actuators;

a switching circuit configured to switch connection destination of each of the actuators to any of the power circuits;

a memory configured to store ranks and a number of actuators associated with each of the ranks, the ranks representing magnitudes of applying voltages, respectively; and a controller configured to control driving of the actuators, wherein the controller is configured to:

select a maximum rank having a largest number of actuators associated therewith from among the ranks stored;

allocate at least two of the power circuits to the maximum rank selected;

control the switching circuit to connect one actuator associated with the maximum rank selected with one of the at least two of the power circuits; and control the switching circuit to connect another actuator associated with the maximum rank selected with another of the at least two of the power circuits.

2. The printing apparatus according to claim 1, wherein the power circuits include a standby power circuit corresponding to a standby power source, and the controller is configured to allocate the standby power circuit to the maximum rank as one of the at least two of the power circuits.

3. The printing apparatus according to claim 1, wherein each of the power circuits is configured to apply voltage to a predetermined number or less of actuators, and the controller is configured to:

whenever one power circuit among the power circuits is allocated to one rank among the ranks, for the one rank to which the one power circuit is allocated, calculate a second number of actuators by subtracting the predetermined number from the number of actuators before allocating the one power circuit;

allocate the power circuits to the ranks in descending order of the number of actuators and the second number of actuators associated therewith;

determine whether there is any unallocated rank without any power circuit, among the power circuits, allocated thereto, after each of the power circuits is allocated to any of the ranks; and based on determining that there is an unallocated rank, allocate, to the unallocated rank, one of the power circuits which has the closest voltage to the voltage of the unallocated rank.

4. The printing apparatus according to claim 1, wherein each of the power circuits is configured to apply voltage to a predetermined number or less of the actuators, and the controller is configured to:

select the maximum rank;

determine whether the number of actuators associated with the selected rank is not more than the predetermined number;

based on determining that the number of actuators associated with the selected rank is not more than the predetermined number, allocate the power circuits to the ranks in descending order of the number of actuators associated therewith;

based on determining that the number of actuators associated with the selected rank is more than the predetermined number, calculate a value of dividing the number of actuators associated with the selected rank by the predetermined number;

divide the number of actuators associated with the selected rank by the value to calculate a sub number of actuators;

allocate the power circuits to the ranks in descending order of the number of actuators and the sub number of actuators associated therewith;

determine whether there is any unallocated rank without any power circuit, among the power circuits, allocated thereto, after each of the power circuits is allocated to any of the ranks; and based on determining that there is an unallocated rank, allocate, to the unallocated rank, one of the power circuits which has the closest voltage to the voltage of the unallocated rank.

5. The printing apparatus according to claim 4, wherein the controller is configured to, after calculating the sub number of actuators, select another rank having the second largest number of actuators next to the selected rank.

6. The printing apparatus according to claim 3, wherein the predetermined number is set according to a property of each of the power circuits, a drive voltage for each of the actuators, the number of actuators, a drive frequency of each of the actuators, or a temperature.

7. The printing apparatus according to claim 3, wherein the power circuits include at least one first power circuit where the predetermined number is a first number, and at least one second power circuit where the predetermined number is a second number different from the first number, and one of the second power circuits is arranged between two of the first power circuits or one of the first power circuits is arranged between two of the second power circuits.

8. The printing apparatus according to claim 1, wherein a maximum allocation number of the power circuits allocatable to each of the ranks is preset, each of the power circuits is configured to apply voltage to a predetermined number or less of the actuators, and the controller is configured to:

whenever one power circuit among the power circuits is allocated to one rank among the ranks, for the one rank to which the one power circuit is allocated, calculate a second number of actuators by subtracting the predetermined number from the number of actuators before allocating the one power circuit;

allocate a number of power circuits not more than the maximum allocation number to the maximum rank, and allocate a number of the power circuits less than the maximum allocation number to each of the other ranks;

determine whether the number of actuators associated with the maximum rank is more than the total number of the predetermined numbers of all of the power circuits allocated to the maximum rank;

based on determining that the number of actuators associated with the maximum rank is more than the total number of the predetermined numbers of all of the power circuits allocated to the maximum rank, calculate a value by subtracting the total number of the predetermined numbers from the number of actuators associated with the maximum rank; and allocate the same number as the calculated value of actuators associated with the maximum rank to the other ranks whose voltage difference from the voltage of the power circuit allocated to the maximum rank is not more than a predetermined value.

9. The printing apparatus according to claim 8, wherein the controller is configured to:

divide the same number as the value of actuators associated with the maximum rank; and allocate the divided actuators respectively to the other ranks.

10. The printing apparatus according to claim 1, wherein the actuators form a plurality of rows arranged in one direction, and based on that, among the plurality of rows, there are multiple rows belonging to one rank among the ranks and being consecutive in the one direction, and based on that one power circuit among the power circuits is allocated to the one rank, the controller is configured to allocate the power circuits to the plurality of rows such that the one power circuit is not consecutive or the number of the one power circuit consecutive in the one direction is not more than a predetermined number.

11. A method implemented by a controller of a printing apparatus including actuators configured to exert force to liquid, power circuits, a switching circuit and a memory, the method comprising:

reading, from the memory, ranks and a number of actuators associated with each of the ranks, the ranks representing magnitudes of applying voltages, respectively;

selecting a maximum rank having a largest number of actuators associated therewith from among the ranks;

allocating at least two of the power circuits to the maximum rank selected;

controlling the switching circuit to connect one actuator associated with the maximum rank selected with one of the at least two of the power circuits; and controlling the switching circuit to connect another actuator associated with the maximum rank selected with another of the at least two of the power circuits.

* * * * *